US005781993A

United States Patent [19]

Conaway

[11] Patent Number: 5,781,993

[45] Date of Patent: Jul. 21, 1998

[54] METHOD FOR PREVENTING OXIDIZATION OF A SILVER-CADMIUM OBJECT

[75] Inventor: Donald E. Conaway, Attleboro, Mass.

[73] Assignee: Checon Corporation, Attleboro, Mass.

[21] Appl. No.: 560,839

[22] Filed: Nov. 20, 1995

[51] Int. Cl.[6] ..... H01R 43/16; H01R 43/02; H01H 11/04

[52] U.S. Cl. ..... 29/885; 29/874; 29/878; 148/277; 148/431; 148/518; 200/266

[58] Field of Search ..... 29/874, 885, 877, 29/878, 879; 148/277, 281, 431, 517, 518; 200/264, 266; 228/264

[56] References Cited

U.S. PATENT DOCUMENTS

| | | | |
|---|---|---|---|
| 3,596,030 | 7/1971 | Shibata | 200/266 |
| 3,666,428 | 5/1972 | Haarbye | 148/431 X |
| 3,688,067 | 8/1972 | Shibata | 200/266 X |
| 3,807,994 | 4/1974 | Jost | 428/938 X |
| 3,814,640 | 6/1974 | Shibata | 29/874 X |
| 4,700,475 | 10/1987 | Jost et al. | 29/874 |
| 4,846,901 | 7/1989 | Lima et al. | 29/874 X |

FOREIGN PATENT DOCUMENTS

| | | | |
|---|---|---|---|
| 2308181 | 11/1976 | France | 29/877 |
| 573167 | 2/1976 | Switzerland | 29/877 |

*Primary Examiner*—Peter Vo
*Attorney, Agent, or Firm*—Fish & Richardson P.C.

[57] ABSTRACT

A one-sided oxidized silver-cadmium object is formed. One side of a silver-cadmium object is covered with a non-silver-cadmium shield to enable the one side to resist oxidation. Then the object is oxidized under conditions that leave substantially unoxidized a layer of the object adjacent the one side. An oxidized silver-cadmium object has a non-silver-cadmium, oxidation-resistant shield attached to one side of the object, the object having a substantially unoxidized layer adjacent the one side.

7 Claims, 3 Drawing Sheets

METHOD FOR PREVENTING OXIDIZATION OF A SILVER-CADMIUM OBJECT

BACKGROUND

Figure 1:
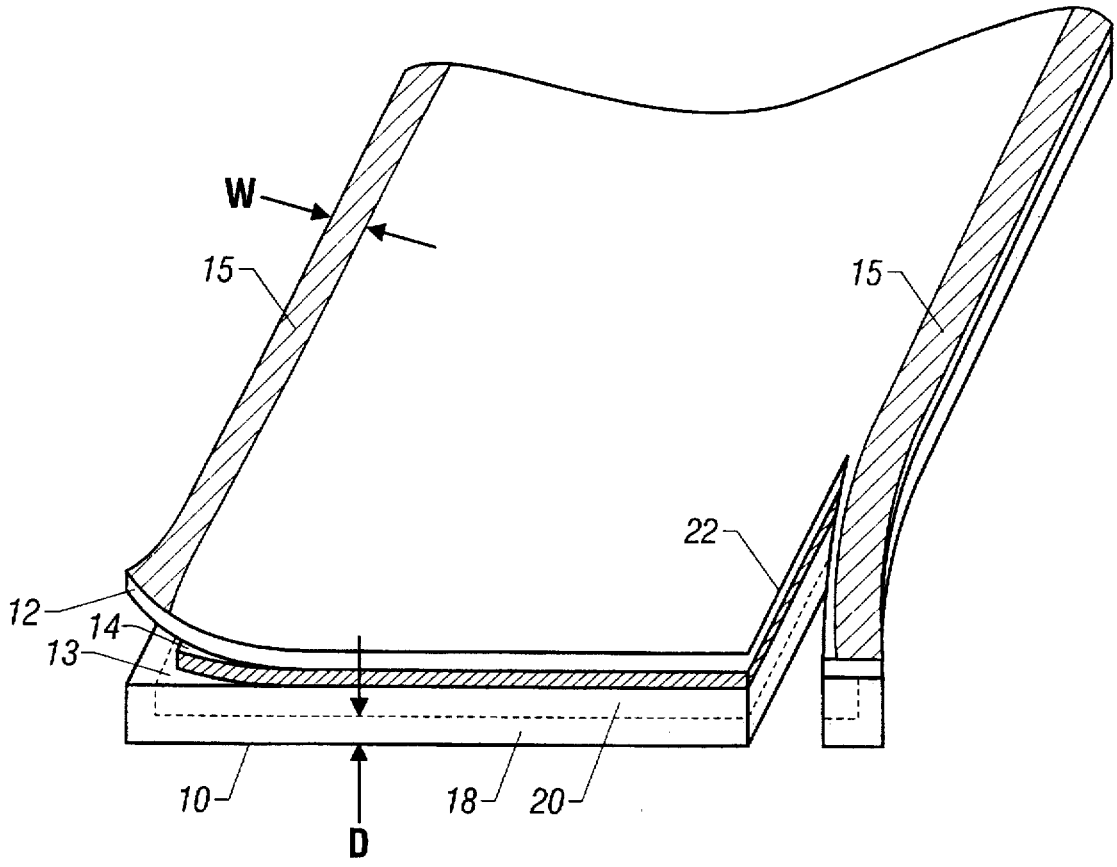

This invention relates to preventing oxidation of a silver-cadmium object.

Just before two electrical contacts touch to complete an electrical circuit, an arc bridges the gap between them, damaging the surfaces of both contacts and sometimes causing the two contacts to weld or "stick" together. Oxidized silver-cadmium is a preferred material for electrical contacts because the cadmium oxide suspended in a silver matrix resists the damage caused by arcing and the resulting welding. Silver-cadmium alloy may be oxidized by subjecting it to oxygen accompanied by heat and pressure or by heat alone, oxidation of the cadmium content of the material progressing inwardly from the exposed surfaces. As pointed out in Jost, et al., U.S. Pat. No. 4,700,475, incorporated by reference, electrical contacts made from such materials suffer from two major drawbacks. First, since the cadmium migrates or diffuses toward the surface of the material during the process of internal oxidation, the center zone of the internally oxidized material lacks the desired concentration of cadmium oxide particles. Consequently, after the contact has eroded during use to approximately one-half of its original thickness, it loses the non-welding characteristics provided by cadmium oxide. Second, such a contact cannot be soldered or brazed to the contact blade material (usually copper alloys), but requires a backing, usually of silver alone, which must be attached in a separate bonding step which increases the cost and provides a possible source of error.

These two drawbacks can be addressed through the use of strips of silver-cadmium, oxidized on one side and not on the other. Such materials, known in industry as "one-side oxidized" or "single phase" silver-cadmium oxide, make good electrical contacts. The oxidized side of the strip contains cadmium oxide particles to resist the arcing and welding to which electrical contacts are prone. The non-oxidized side of the strip provides a good surface for bonding to another surface.

It has previously been proposed as described in Shibata U.S. Pat. No. 3,688,067 to apply, by way of pressure-bonding, plating or vaporizing, an antioxidant layer of another metal, such as nickel, chromium, aluminum, copper, iron or alloys thereof, to one face of a silver-cadmium object. Shibata then suggests internally oxidizing the silver-cadmium object for a sufficient time that cadmium-oxide particles are distributed throughout the object. The distribution is not uniform because oxidation is prevented through the face of the object shielded by the antioxidant layer, causing a smaller concentration of calcium-oxide particles adjacent that face. Shibata then proposes heating the internally oxidized silver-cadmium object in a reducing atmosphere, forming an unoxidized layer on the surfaces of the silver-cadmium object not covered by the antioxidant layer. The antioxidant layer prevents reduction of the shielded face of the object, such that when the antioxidant layer is removed, an oxidized surface is revealed. This method has been proven impractical and is not known to be used in industry.

Shibata alternatively proposes mating two pieces of silver-cadmium alloy together and welding them at their mated faces into a single plate before subjecting the result to internal oxidation and reduction as above, followed by separation into two pieces. Finally, Shibata proposes subjecting a doubly thick plate of silver-cadmium alloy to internal oxidation and reduction as above, followed by cutting the plate in half.

It has also been proposed in Jost U.S. Pat. No. 3,807,994 to pressure-bond a strip of silver-cadmium alloy contact material to a thin layer of silver or to layers of silver-cadmium alloy of varying cadmium content before internal oxidation.

It has also been proposed in Jost et al. U.S. Pat. No. 4,700,475 to form a tube of silver-cadmium alloy, to insert within the tube a parting compound, to flatten the tube so that its inner faces are separated only by the parting compound, to internally oxidize the tube so that the alloy adjacent the outer surface of the flattened tube is oxidized and the alloy adjacent the inner surface is not, to open the tube by slitting or cutting it, and to remove the parting compound.

SUMMARY

In general, in one aspect, the invention features a method for use in forming a one-sided oxidized silver-cadmium object. One side of a silver-cadmium object is covered with a non-silver-cadmium shield to enable the one side to resist oxidation. Then the object is oxidized under conditions that leave substantially unoxidized a layer of the object adjacent the one side.

Implementations of the invention may include one or more of the following. The unoxidized object may be coiled. The covering step may include welding the non-silver-cadmium shield to the one side of the silver-cadmium object. The welding step may include seam welding or electron-beam welding the non-silver-cadmium shield to the one side of the silver-cadmium object. The welding step may produce a weld having a width greater than the thickness of an oxidized layer on the oxidized object. The unoxidized object may be formed into a strip. A parting compound may be inserted between the unoxidized layer and the non-silver-cadmium shield. The covering step may include applying the non-silver-cadmium shield by electro deposit or by spray-metallizing deposit.

In general, in another aspect, the invention features an oxidized silver-cadmium object having a non-silver-cadmium, oxidation-resistant shield attached to one side of the object, the object having a substantially unoxidized layer adjacent the one side.

Advantages of the invention may include one or more of the following.

The invention may reduce processing costs, which are related to the length of the strip being processed, by producing strips of one-side oxidized silver-cadmium approximately twice the length of those produced with existing methods used in industry. Processing costs may be lowered because the silver-cadmium strips are thicker than is possible with existing methods. The yield of silver-cadmium may be increased by reducing the amount of waste.

Other advantages and features will become apparent from the following description and from the claims.

DESCRIPTION

Figure 2:
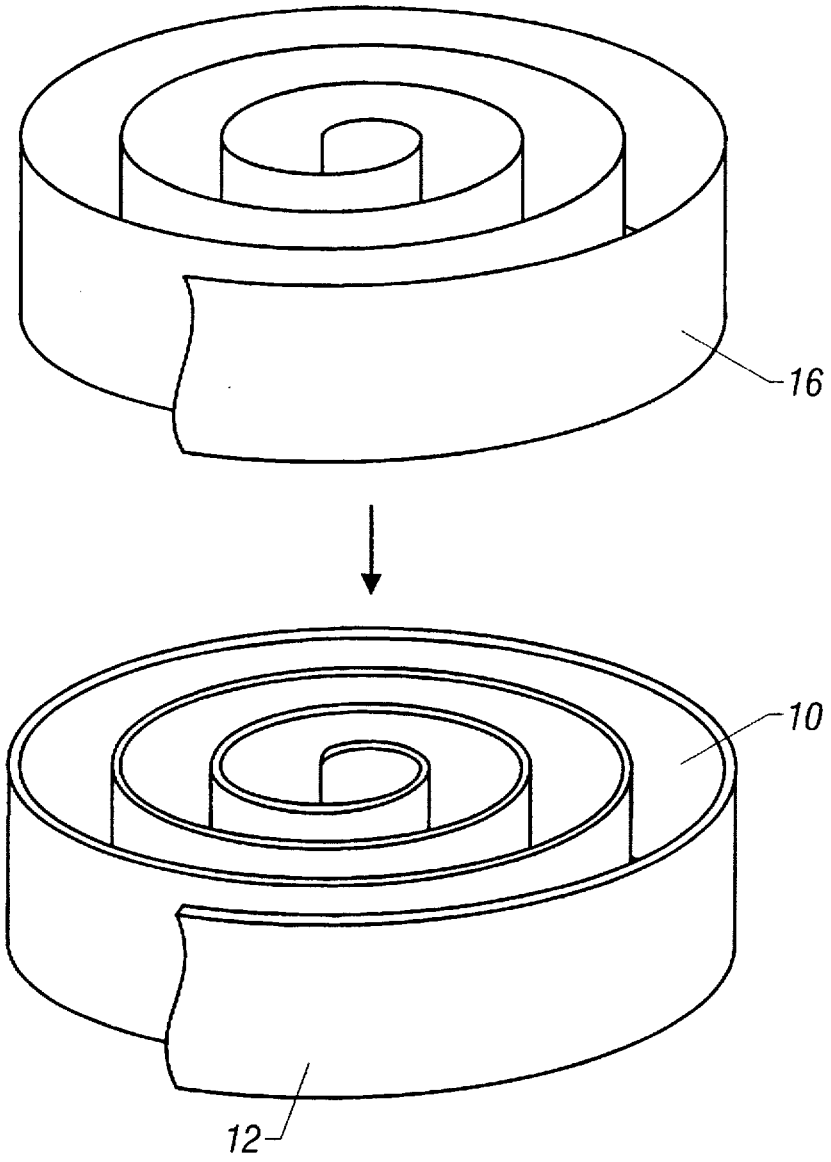
Figure 3:
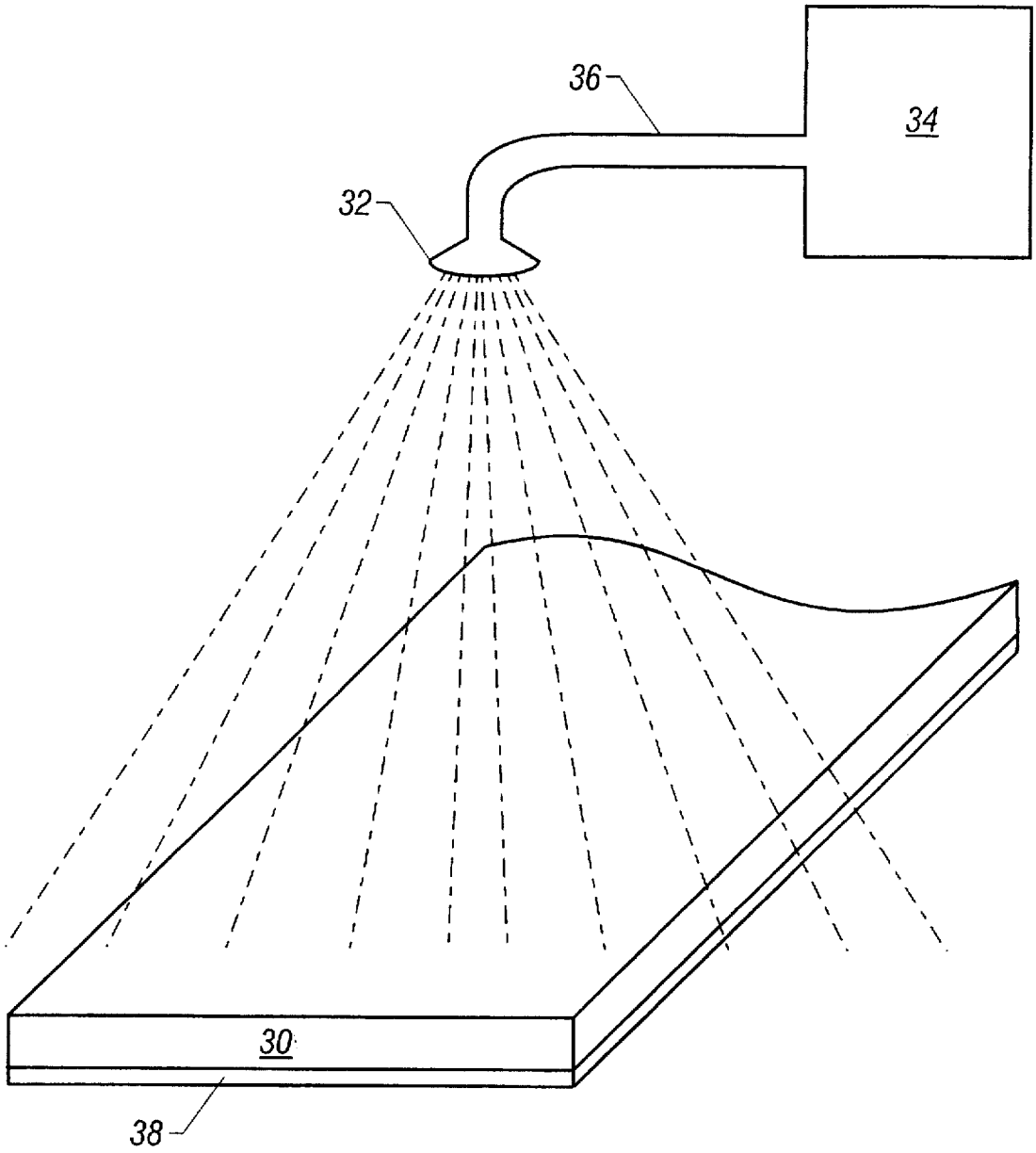

FIGS. 1 and 2 are perspective views of steps in making one-sided oxidized silver-cadmium; and FIG. 3 is a perspective view of another technique for making one-side oxidized silver-cadmium.

A strip 10 of silver-cadmium alloy, shown in FIG. 1, is an alloy containing 5 to 20 percent cadmium by weight. The strip 10 can have any width, length and thickness, limited by the capacity of the oxidation equipment and the equipment used to process the one-side oxidized strip into electrical contacts. The strip's thickness is also limited by the capacity of the equipment used to prepare the strip for oxidation as described below.

A protective backing 12 is attached to the strip 10 of silver-cadmium. The protective backing is made of a material, such as nickel, capable of protecting the upper surface 13 of strip 10 from oxidation. A strip of parting compound 14 is inserted between the silver-cadmium alloy strip and the protective backing strip to prevent the two strips from bonding during oxidation. The parting compound can be any material, such as those materials described in Jost U.S. Pat. No. 4,700,475, which is chemically inert to the silver-cadmium alloy and which does not melt or become alloyed with the silver-cadmium alloy at temperatures required for the subsequent internal oxidation step. The protective backing is attached to the silver-cadmium alloy strip by wide weld bands 15 such as are produced by seam or electron-beam welding.

A spiral-bound strip of stainless steel mesh 16 is inserted between the windings of the spiral-wound strip of silver-cadmium alloy with attached protective backing, as in FIG. 2, to prevent the windings of silver-cadmium alloy from bonding to each other during oxidation.

The silver-cadmium alloy strip 10 and its protective backing 12 are wound into a loose spiral, as in FIG. 2. Because the silver-cadmium alloy strip and its protective backing together are approximately only half as thick as the strips currently used in industry, the strip may be approximately twice as long and still yield the same diameter of spiral.

The spiral-wound strip of silver-cadmium alloy with attached protective backing is placed in a furnace where it is exposed to heat and pressure or to heat alone. The spiral-wound silver-cadmium alloy is oxidized for a period that varies according to the desired depth D of internal oxidation. The depth of internal oxidation depends on the time, temperature, oxygen concentration and pressure of the internal oxidation step and on the cadmium concentration in the alloy, as described in Jost U.S. Pat. No. 4,700,475. These factors are controlled to oxidize the layer 18 adjacent the surfaces of the silver-cadmium object not covered by the antioxidant layer to a sufficient depth that those surfaces exhibit the desired anti-arcing and anti-welding characteristics. The factors are also controlled to leave substantially unoxidized the layer 20 of the object protected from the oxidation environment by the antioxidant layer, allowing that surface to retain its good bonding characteristics. Finally, the factors are controlled to keep the depth of internal oxidation D less than the width W of the weld bands 15, to maintain the integrity of the welds during oxidation.

After oxidation, the one-side oxidized spiral-wound silver-cadmium alloy and protective backing are removed from the furnace and allowed to cool. The strip is then unwound from its spiral. The oxidized edges of the one-side oxidized silver-cadmium strip are sliced away 22. This step also removes the attachment between the one-side oxidized silver-cadmium strip and the protective backing. The protective backing and parting compound are removed and discarded. The resulting silver-cadmium strip is one-side oxidized, having an oxidized layer 18 and an unoxidized layer 20.

Other embodiments are within the scope of the following claims.

For example, the protective backing may be applied by spraying, as shown in FIG. 3. A strip of silver-cadmium alloy 30 is passed beneath a spray nozzle 32, which receives a stream of liquid antioxidant material from a reservoir 53 by way of supply line 36. The spray nozzle atomizes the antioxidant material and sprays it on the silver-cadmium alloy strip 50. The antioxidant material is applied to a sufficient thickness to protect the silver-cadmium strip from oxidation.

A mask 38 may be applied to surfaces not desired to be covered with the protective backing. After the protective backing is applied, the mask is removed and the silver-cadmium alloy strip is oxidized as before. The surface previously covered by the mask is oxidized and the surface covered by the protective backing is not. After the oxidation step, the protective backing is removed by a milling machine.

The protective backing may be applied by a cladding process or metal deposit, such as electro or spray-metallizing deposit.

What is claimed is:

1. A method for use in forming a one-side oxidized silver-cadmium object comprising welding a non-silver-cadmium shield to one side of the silver-cadmium object with a weld having a width, the shield enabling the one side to resist oxidation, oxidizing the object under conditions that leave substantially unoxidized a layer of the object adjacent the one side, the oxidized object having an oxidized layer, the oxidized layer having a thickness, the width of the weld being greater than the thickness of the oxidized layer.

2. The method of claim 1 further comprising removing the shield.

3. The method of claim 1 further comprising coiling the silver-cadmium object prior to the oxidation.

4. The method of claim 1 wherein welding comprises seam welding the non-silver-cadmium shield to the one side of the silver-cadmium object.

5. The method of claim 1 wherein welding comprises electron-beam welding the non-silver-cadmium shield to one side of the silver-cadmium object.

6. The method of claim 1 further comprising forming the silver cadmium object into a strip.

7. The method of claim 1 further comprising inserting a parting compound between the one side of the silver-cadmium object and the non-silver-cadmium shield.

* * * * *